US006289646B1

(12) United States Patent
Watanabe

(10) Patent No.: US 6,289,646 B1
(45) Date of Patent: Sep. 18, 2001

(54) METAL FIXTURE ASSEMBLY FOR INSTALLATION OF VERTICAL SIDINGS, CONSTRUCTION AND METHOD OF INSTALLATION

(75) Inventor: Morimichi Watanabe, Nagoya (JP)

(73) Assignee: Nichiha Co., Ltd., Nagoya (JP)

( * ) Notice: Subject to any disclaimer, the term of this patent is extended or adjusted under 35 U.S.C. 154(b) by 0 days.

(21) Appl. No.: 09/513,466

(22) Filed: Feb. 25, 2000

(30) Foreign Application Priority Data

Mar. 26, 1999 (JP) ..... 11-083853

(51) Int. Cl.[7] ..... E04B 2/00

(52) U.S. Cl. ..... 52/506.01; 52/235; 52/775; 52/546; 52/506.08; 52/489.1

(58) Field of Search ..... 52/235, 520, 521, 52/543, 549, 506.01, 506.06, 506.08, 508, 511, 513

(56) References Cited

U.S. PATENT DOCUMENTS

| | | | | |
|---|---|---|---|---|
| 4,625,481 | * | 12/1986 | Crandell | 52/235 |
| 4,648,231 | * | 3/1987 | Laroche | 52/775 |
| 6,055,787 | * | 5/2000 | Gerhaher et al. | 52/546 |
| 6,098,364 | * | 8/2000 | Liu | 52/506.08 |
| 6,202,377 | * | 3/2001 | Krieger | 52/489.1 |

FOREIGN PATENT DOCUMENTS

| | | |
|---|---|---|
| 61-147824 | 9/1986 | (JP) . |
| 8-93177 | 4/1996 | (JP) . |

* cited by examiner

*Primary Examiner*—Carl D. Friedman
*Assistant Examiner*—Steve Varner
(74) *Attorney, Agent, or Firm*—Oblon, Spivak, McClelland, Maier & Neustadt, P.C.

(57) ABSTRACT

A metal fixture assembly for installation of vertical sidings to fix the siding to a furring, which is capable of providing a construction of the installation having excellent appearance and weathering, and a method using the metal fixture assembly to facilitate the installation. A metal fixture assembly for installation of a vertical lower siding and a vertical upper siding vertically adjacent to each other on a furring is positioned therebetween. The metal fixture assembly includes a fastening metal fixture to be fixed to the furring, an upper metal fitting provided between the fastening metal fixture and the upper siding and fittingly fixed on a bottom portion thereof, and a lower metal fitting provided between the fastening metal fixture and the lower siding and fittingly fixed on a top portion thereof. The fastening metal fixture has a fixing part to be fixed to the furring, a supporting part projecting from the fixing part to support the lower and upper sidings, an upper locking part provided between the fixing part and the supporting part and locking the upper metal fitting thereto, and a lower locking part provided between the fixing part and the supporting part and locking the lower metal fitting thereto.

8 Claims, 9 Drawing Sheets

8
2
724
72
71
6
24
4
723
3
23
31
712
41

METAL FIXTURE ASSEMBLY FOR INSTALLATION OF VERTICAL SIDINGS, CONSTRUCTION AND METHOD OF INSTALLATION

BACKGROUND OF THE INVENTION

1. Field of the Invention

The present invention relates to a metal fixture assembly for installation of vertical sidings, and a construction and a method for the installation of the same.

2. Description of the Related Arts

A metal fixture assembly is employed for installation of vertical board sidings using for example ceramic siding boards to be anchored to a building frame. Such ceramic siding boards are attached to a building frame with the longitudinal length thereof being oriented in the vertical direction.

As a conventional metal fixture for the vertical siding, a flashing 9 which is bent-formed into an S-shape in cross section is known, as shown in FIGS. 8 and 9. The flashing is a material which drains rainwater attached to the siding to a surface of the siding therethrough.

The flashing 9 is interposed between upper and lower sidings 71 and 72, with an upper folded-back portion 91 thereof in contact with a rear surface of a bottom portion 723 of the upper siding 72, and with a lower folded-back portion 92 of the flashing 9 in contact with a front surface of a top portion 712 of the lower siding 71.

The flashing 9 and the upper siding 72 are fixed to a furring 6 with a nail 8 through a horizontal furring strip 96. Similarly, the lower siding 71 is fixed to the furring 6 with another nail 8. Reference numeral 61 of FIG. 8 denotes building paper.

However, such a conventional metal fixture has the following problems.

That is, the sidings 71 and 72 vertically adjacent to each other cannot be fixed to the furring 6 with the flashing 9 since its use is originally for weathering. Thus, as described above, the sidings 71 and 72 are fixed to the furring 6 by nailing with the nails 8. Consequently, the heads of the nails 8 are exposed on the surface of each of the sidings 71 and 72, resulting in a degraded external appearance.

In order to solve the problem, after the sidings 71 and 72 are fixed to the furring 6, nail heads are coated with retouching paint or covered with a kneehole panel. In this case, however, much time and labor are required.

Moreover, because the flashing 9 is mounted between the sidings 71 and 72 (horizontal joint) as greatly exceeding width thereof, it protrudes onto the surface of the siding 72, which degrades an appearance of the horizontal joint.

SUMMARY OF THE INVENTION

It is therefore an object of the present invention to provide a metal fixture assembly capable of fixing vertical sidings vertically adjacent to each other to a furring. It is another object of the present invention to provide a construction of installed vertical sidings that is excellent in its appearance and weathering. It is still another object of the present invention to provide a vertical siding installation method.

There is provided a metal fixture assembly for installation of a vertical siding arranged between vertical sidings vertically adjacent to each other, including a fastening metal fixture to be fixed to a furring, an upper metal fitting provided between the fastening metal fixture and the upper siding and fittingly fixed on a bottom portion of the upper siding, and a lower metal fitting provided between the fastening metal fixture and the lower siding and fittingly fixed on a top portion thereof, wherein the fastening metal fixture has a fixing part to be fixed to the furring, a supporting part projecting-formed from the fixing part to support the sidings, an upper locking part provided between the fixing part and the supporting part which locks the upper metal fitting, and a lower locking part provided therebetween which locks the lower metal fitting.

The key feature of the present invention is that the upper and lower metal fittings fittingly fixed on the top and bottom portions of the siding are arranged to be locked to the fastening metal fixture to be fixed to the furring.

The metal fixture assembly of this invention is used in fixing vertical sidings which are vertically adjacent to each other to a furring, as being arranged between those sidings. In fixing sidings on a furring with this metal fixture assembly, for example, there is provided a method in which an upper metal fitting and a lower metal fitting are fittingly fixed to top and bottom portions of the sidings, respectively, and the metal fittings and a fastening metal fixture are locked, thereby installing the sidings one by one from bottom to top. The method is detailed hereinafter.

The upper metal fitting is fittingly fixed on a bottom portion of the siding, and the lower metal fitting is fittingly fixed on a top portion thereof. The lower locking part of the fastening metal fixture is locked to the lower metal fitting, and then the fastening metal fixture is fixed to the top portion of the siding through the lower metal fitting.

Then, the upper metal fitting fittingly fixed on the bottom portion of the siding is locked to the upper locking part of another fastening metal fixture previously fixed to a furring. In this manner, the supporting part of the fastening metal fixture supports the siding.

Then, the fastening metal fixture fitted on the top portion of the siding through the lower metal fitting is fixed to the furring. In this manner, the siding is fixed to the furring.

Then, another siding to which the upper and lower metal fittings and the fastening metal fixture have been fixed is installed one by one upward the siding fixed on the furring in the similar method.

The method of installing vertical sidings on the furring by using the inventive metal fixture assembly is not limited to the above-described method.

According to the present invention, it is possible to securely install the sidings on the furring, by making the sidings to be supported by the fastening metal fixture fixed to the furring through the upper and lower metal fittings.

Further, no nails are required to be driven into the sidings because the installation of the sidings can be achieved by fitting the metal fittings to the sidings, locking the metal fittings and the fastening metal fixture thereto, and fixing the fastening metal fixture on the furring. Thus, the head of the nail is not exposed on the surface of the siding and this leads to an improved siding appearance.

Preferably, the metal fitting is fittingly fixed on the siding with an adhesive agent, screws, or the like. According to this, a gap is not formed between the metal fitting and the siding. Thus, rainwater does not penetrate inward from the gap between the metal fitting and the siding. Therefore, penetration of rainwater and the like into buildings can be prevented, leading to a further improved weathering.

The metal fitting can be locked to the fastening metal fixture, with a space formed between the fastening metal fixture and the metal fitting. Thus, with the siding fixed to the furring, it is possible to function the space as an air pocket. Namely, even though a s light gap is formed between the fastening metal fixture and the metal fitting and even though rainwater penetrates thereinto, it is possible to prevent rainwater from penetrating inward from the space.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
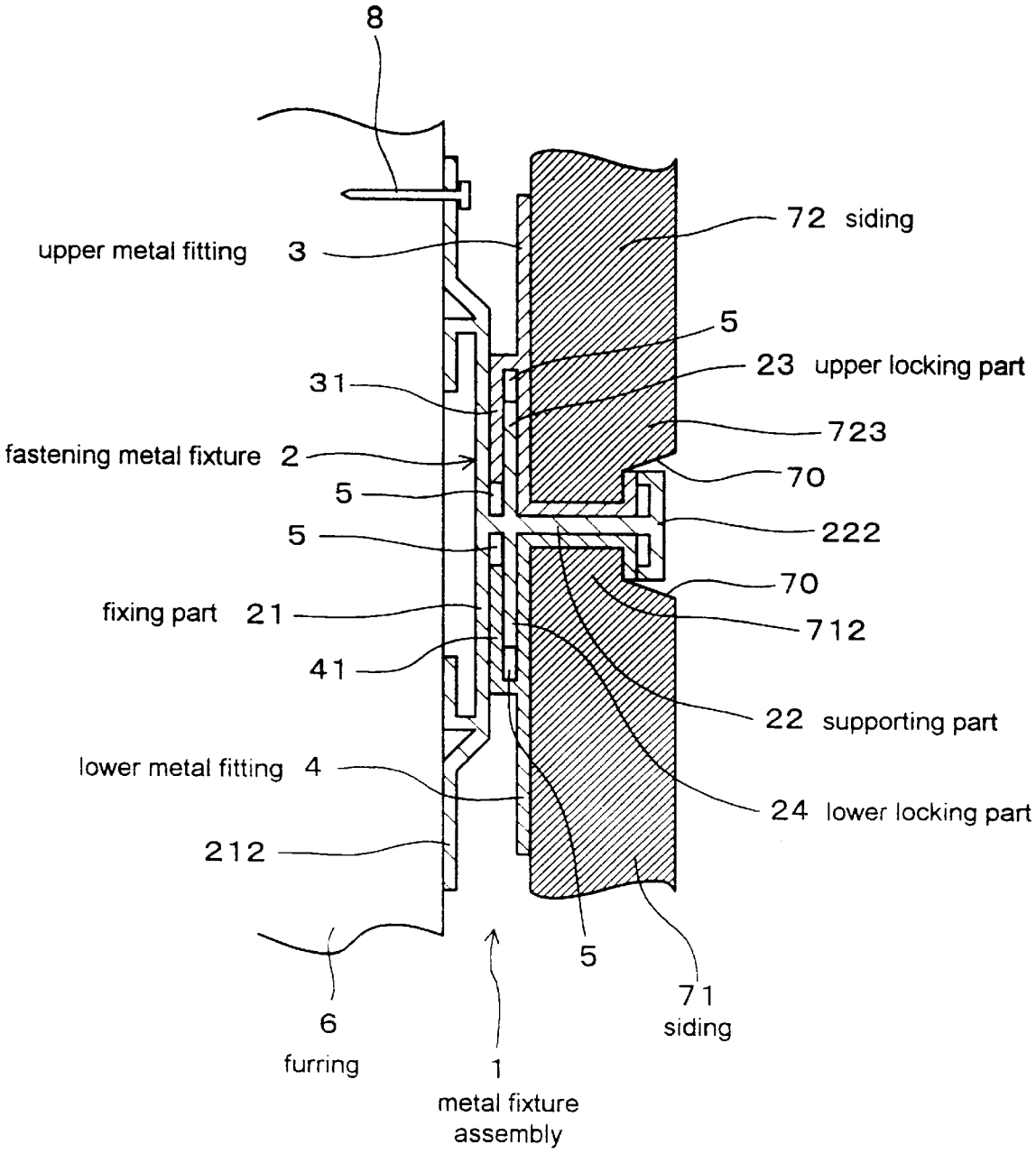
FIG. 1 is a vertical sectional view showing a metal fixture assembly at completion of installation thereof in Embodiment 1.

Referring now to the drawings, wherein like reference numerals designate identical or corresponding parts throughout the several views.

It is preferable that the upper locking part and lower locking part of the fastening metal fixture are plate-shaped, that the upper metal fitting has a plate-shaped hooking portion locked to the upper locking part, and that the lower metal fitting has a plate-shaped hooking portion locked to the lower locking part.

In this case, the plate-shaped hooking portion of the upper metal fitting can easily be locked to the upper locking part of the fastening metal fixture. The lower locking part of the fastening metal fixture can also be locked easily to the plate-shaped hooking portion of the lower metal fitting.

Preferably, a fixing part of the fastening metal fixture has a main plate portion from which the supporting part projects toward the face of siding and a pair of fixing plates portion formed at each of upper and bottom portions of the main plate portion, and the fixing plate portion is bent-formed toward a nearer side to the furring than the main plate portion.

In this case, the fastening metal fixture allows the siding to be installed on the furring, with a ventilation provided between the main plate portion and the furring, and it is possible to easily fix the siding to the furring.

Preferably, the main plate portion has a bottom plate flush with the fixing plate portion.

In this case, the siding can be securely fixed to the furring, with a ventilation provided by the bottom plate between the main plate portion and the furring, and it is possible to securely fix the siding to the furring.

Preferably, the supporting part has a belt-shaped plate at a front end thereof.

In this case, it is possible to prevent the front end of the upper metal fitting and lower metal fitting from being displaced from a predetermined position, respectively, and the design property of the siding after installation can be improved.

There is provided a construction having vertical sidings installed on a furring with the above-described metal fixture assembly, wherein a fixing part of the fastening metal fixture is fixed to a furring; and upper and lower metal fittings are locked to upper and lower locking parts, respectively provided between the fixing part of the fastening metal fixture and the supporting part thereof; and a bottom portion of the upper siding is fittingly fixed in the upper metal fitting, and a top portion of the lower siding is fittingly fixed in the lower metal fitting.

In the above construction, because the metal fixture is used, a nail head is not exposed on the surface of the sidings. Therefore, it is unnecessary to coat the nail head with retouching paint or mount a kneehole panel on the surface of each of the sidings. Thus, it is possible to install the sidings in a short period of time, achieving a remarkably reduced cost.

Further, as described above, it is possible to prevent rainwater and the like attached to the surface of the siding from penetrating inward from a horizontal joint between the sidings which are vertically adjacent to each other.

There is provided a method of installing vertical sidings on a furring by using the inventive metal fixture assembly, comprising the steps of:

fittingly fixing the upper metal fitting on a bottom portion of a siding and fittingly fixed the lower metal fitting on a top portion of the siding;

locking a lower locking part of the fastening metal fixture to the lower metal fitting to fit up the fastening metal fixture on the top portion of the siding;

locking an upper metal fitting fittingly fixed on the bottom portion of the siding to an upper locking part of another fastening metal fixture previously fixed to a furring;

fixing the fastening metal fixture fitted up on the top portion of the siding to the furring; and fittingly fixing the upper metal fitting on a bottom portion of another siding, and fitting the fastening metal fixture on a top portion of said another siding through the lower metal fitting to install said another siding on the siding which has previously been fixed one by one upward the siding fixed on the furring in the similar method as described above.

In the above method, because the metal fixture assembly is used, the siding can be easily and securely installed on the furring, as described below.

Namely, the upper and lower metal fittings are fitted on the bottom and top portions of the siding respectively in advance and the fastening metal fixture is locked to the lower metal fitting such that the siding and the above three kinds of fixtures are integrated. Thus, fixing of the fastening metal fixture on the furring and fixing of the siding thereon can be accomplished simultaneously. Therefore, this method allows the installation of the siding to be performed more easily than the following method in which the fastening metal fixture, the upper and lower metal fittings, and the siding are sequentially installed.

Preferably, the lower metal fitting is fittingly fixed on a top portion of a siding positioned at the lowest stage; the lower locking part of the fastening metal fixture is locked to the lower metal fitting to fit up the fastening metal fixture on the top portion of the siding; a bottom portion of the siding is fittingly fixed in a ground sill flashing previously provided on the furring at a lower portion thereof; and the fastening metal fixture previously fitted on the top portion of the siding is fixed to the furring.

In this case, the fastening metal fixture fixed to the top portion of the lowest siding is fastened to the furring, as the siding being supported by the ground sill flashing. Thus, fixing of the fastening metal fixture on the furring and fixing of the siding thereon can be accomplished simultaneously.

EMBODIMENT

Embodiment 1

The metal fixture assembly for installation of a vertical siding, and a construction and a method for the installation according to an embodiment of the present invention will be described below with reference to FIGS. 1 to 7.

As shown in FIGS. 1 to 7, a metal fixture assembly (hereinafter referred to as fixture assembly) 1 of Embodiment 1 is used to install vertical sidings (hereinafter referred to as siding) 71 and 72 on a furring 6, which is arranged between the sidings 71 and 72.

More specifically, as shown in FIG. 1, the fixture assembly 1 comprises a fastening metal fixture (hereinafter referred to as fastening fixture) 2 to be fixed to a furring 6; an upper metal fitting (hereinafter referred to as upper fitting) 3 and a lower metal fitting (hereinafter referred to as lower fitting) 4 respectively provided between the fastening fixture 2 and the sidings 71 and 72 and fittingly fixed on end portions thereof.

Figure 2:
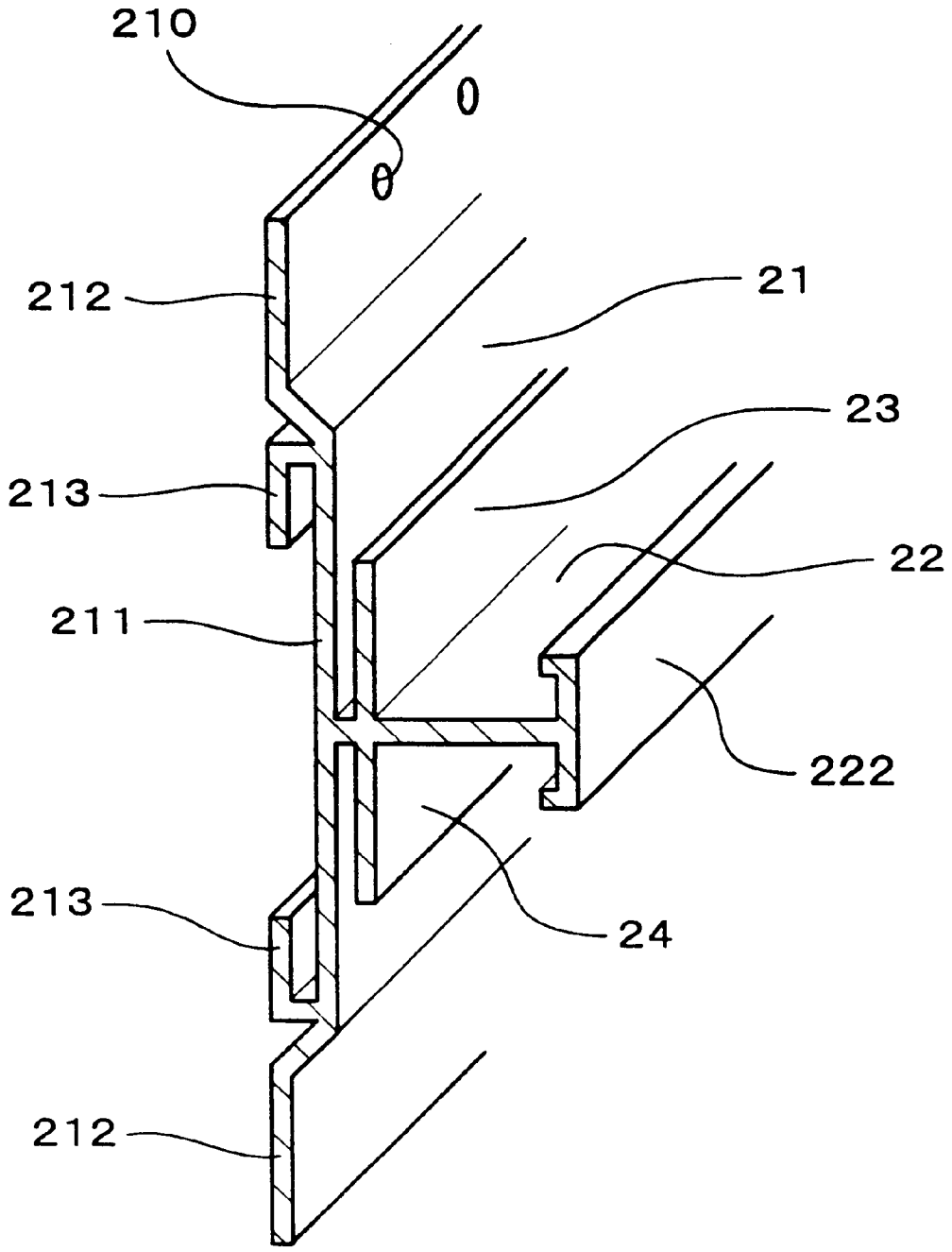
FIG. 2 is a perspective view partly in section showing a fastening metal fixture in Embodiment 1.

As shown in FIGS. 1 and 2, the fastening fixture 2 has a fixing part 21 to be fixed to the furring 6, a supporting part 22 projecting toward the front of the upper and lower sidings 71 and 72 from the fixing part 21 to support the sidings 71 and 72, an upper locking part 23 provided between the fixing part 21 and the supporting part 22 and locking the upper fitting 3 thereto, and a lower locking part 24 provided between the fixing part 21 and the supporting part 22 and locking the lower fitting 4 thereto.

The construction of the fixture assembly 1 will be described in detail below.

The fastening fixture 2, the upper fitting 3, and the lower fitting 4 are formed of a molded aluminum material. In this embodiment, upper and lower parts of the fastening fixture 2 are formed almost symmetrically and the upper fitting 3 and the lower fitting 4 are formed in the same configuration.

As shown in FIGS. 1 and 2, the fastening fixture 2 comprises the fixing part 2 1, the supporting part 22, the upper locking part 23, and the lower locking part 24.

The fixing part 21 has a main plate portion 211 from which the supporting part 22 projects forward and a pair of fixing plate portions 212 formed on upper and bottom portions of the main plate portion 211.

The fixing plate portion 212 is bent-formed toward a nearer side to the furring 6 than the main plate portion 211. The upper fixing plate portion 212 has nail holes 210. The main plate portion 211 has bottom plates 213 flush with the fixing plate portion 212.

The supporting part 22 is T-shaped in section whose tip portion bifurcates vertically, and the front end thereof has a belt-shaped plate 222.

The upper locking part 23 and the lower locking part 24 are plate-shaped and respectively formed upward and downward from a base end portion of the supporting part 22, with a gap provided between the main plate portion 211 and the upper locking part 23 and between the main plate portion 211 and the lower locking part 24, respectively.

Figure 3A:
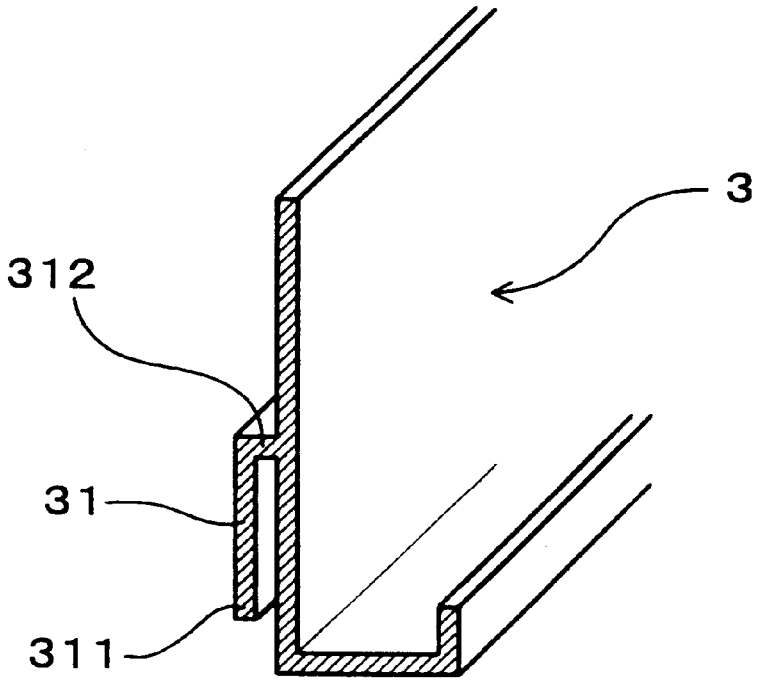
FIG. 3A is a perspective view partly in section showing an upper metal fitting in Embodiment 1.

As shown in FIGS. 1 and 3A, the upper fitting 3 is L-shaped in section which is allowed to contact the lower and rear surfaces of the upper siding 72. The upper fitting 3 has on its rear surface a plate-shaped hooking portion 31 to be locked to the upper locking part 23 of the fastening fixture 2. The plate-shaped hooking portion 31 has a thickness almost equal to the width of the gap between the main plate portion 211 and the upper locking part 23. The width of the gap between the plate-shaped hooking portion 31 and the main body of the upper fitting 3 is almost equal to the thickness of the upper locking part 23.

Figure 3B:
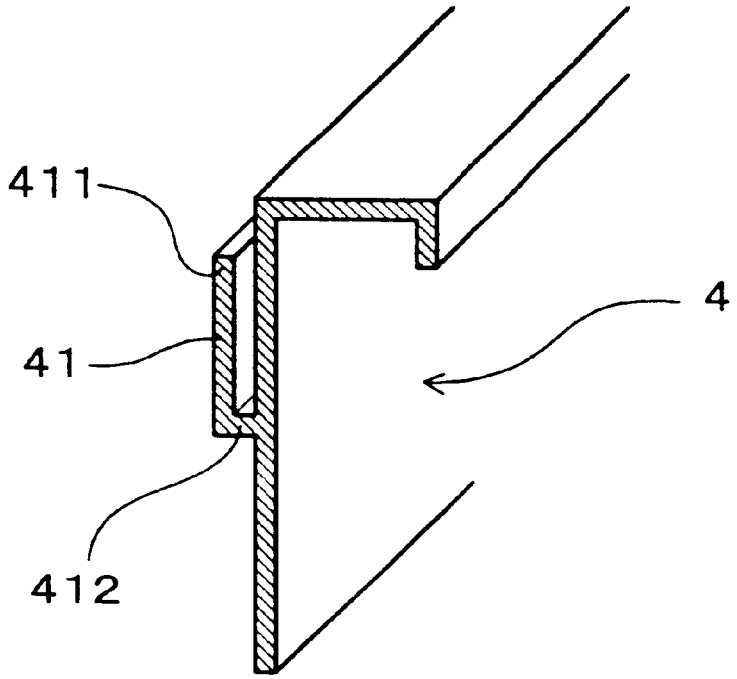
FIG. 3B is a perspective view partly in section showing a lower metal fitting in Embodiment 1.

Similarly, as shown in FIGS. 1 and 3B, the lower fitting 4 is L-shaped in section which is allowed to contact upper and rear surfaces of the lower siding 71. The lower fitting 4 has on its rear surface a plate-shaped hooking portion 41 to be locked to the lower locking part 24 of the fastening fixture 2.

Base end portions 312 and 412 and tip portions 311 and 411 of each of the plateshaped hooking portions are provided in a position at which a space 5 is formed between the fastening fixture 2 when locking is performed.

An example of the method of installing the vertical siding on a furring by using the fixture assembly is described below.

Figures 4A, 4B, 4C:
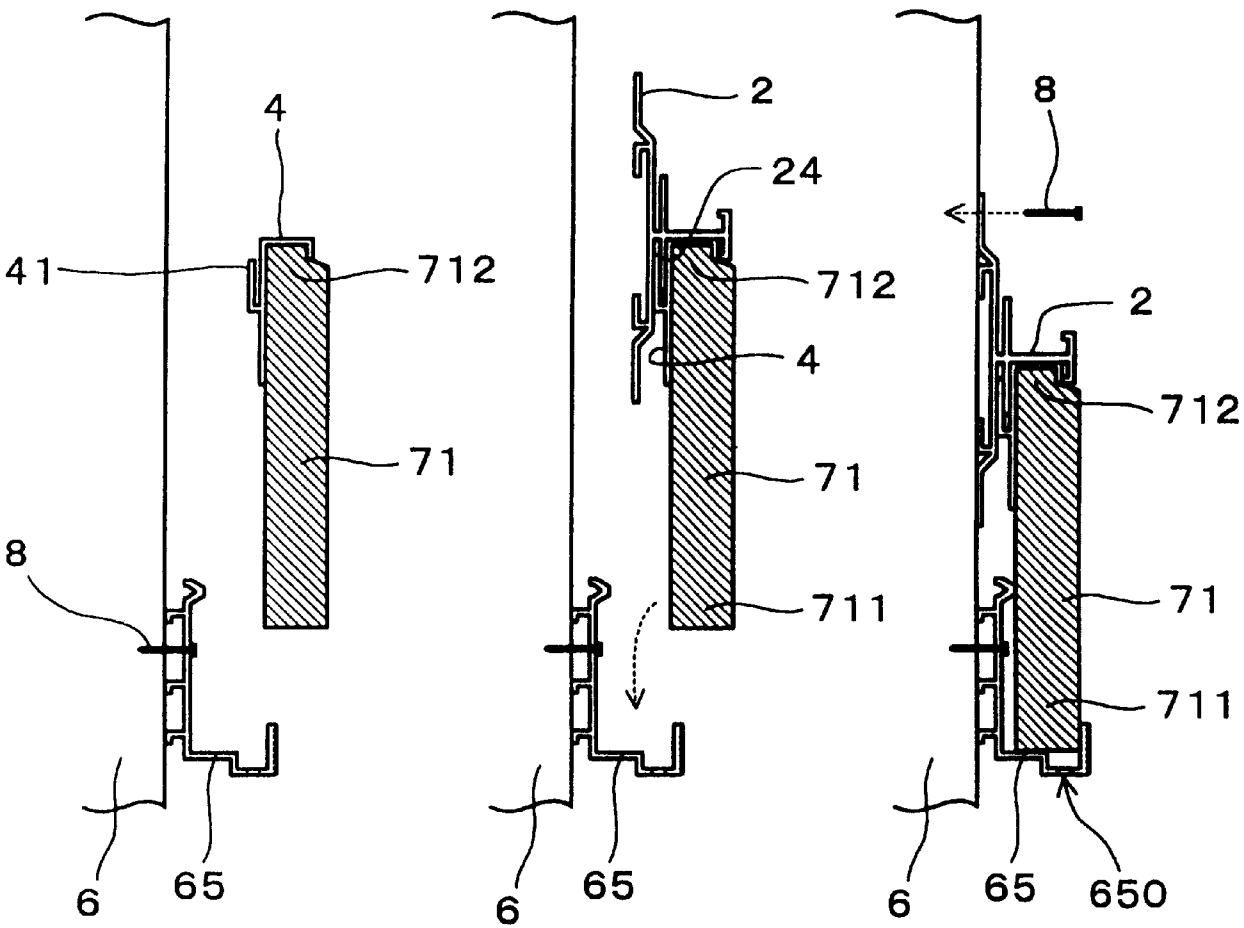
FIGS. 4A, 4B, and 4C are explanatory views showing an installing method in Embodiment 1.

Initially, as shown in FIG. 4A, a ground sill flashing 65 (see FIG. 6) is fixed to the furring 6 with nails 8.

The lower fitting 4 is fittingly fixed with an adhesive agent on a top portion 712 of the siding 71 to be positioned at the lowest stage. Then, as shown in FIG. 4B, the lower locking part 24 of the fastening fixture 2 is locked to the plate-shaped hooking portion 41 of the lower fitting 4 to fit up the fastening fixture 2 on the top portion 712 of the siding 71.

Then, as shown in FIG. 4C, a bottom portion 711 of the siding 71 is fittingly fixed on the ground sill flashing 65 provided on the lower portion of the furring 6. Then, the fastening fixture 2 fitted up on the top portion 712 of the siding 71 is fixed to the furring 6 with nails 8.

Figures 5A, 5B, 5C:
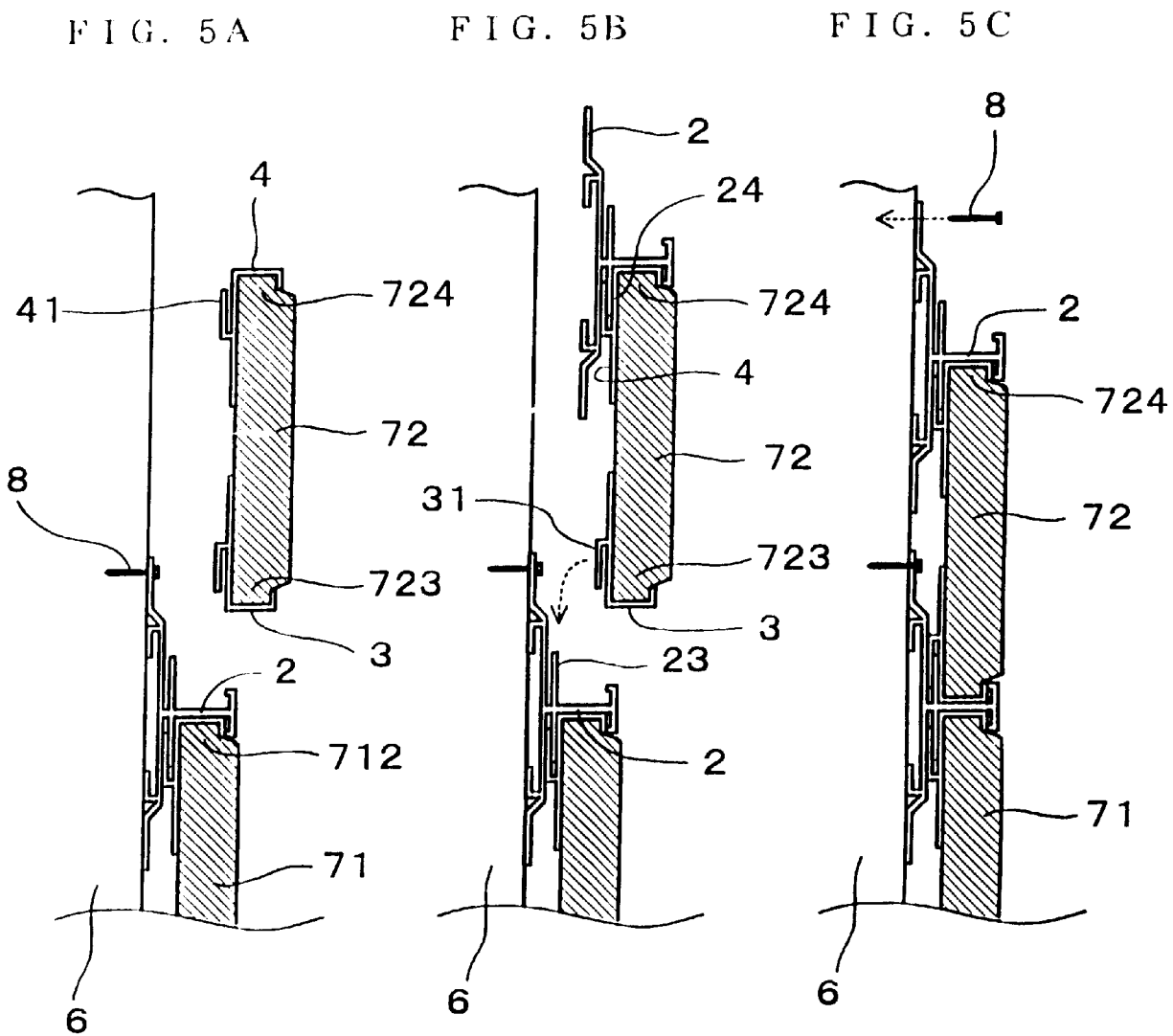
FIGS. 5A, 5B, and 5C are explanatory views subsequent to FIG. 4 showing the installing method in Embodiment 1.

Then, as shown in FIGS. 5A to 5C, the siding 72 to be positioned at a second stage from the lowest stage is installed on the furring 6.

Namely, as shown in FIG. 5A, the upper fitting 3 is fittingly fixed with an adhesive agent on a bottom portion 723 of the siding 72 to be installed at the second stage from the lowest stage, and the lower fitting 4 is fittingly fixed on a top portion 724 of the siding 72. As shown in FIG. 5B, the lower locking part 24 of the other fastening fixture 2 is locked to the plate-shaped hooking portion 41 of the lower fitting 4 to fit up the other fastening fixture 2 on the top portion 724 of the siding 72.

Then, the plate-shaped hooking portion 31 of the upper fitting 3 fittingly fixed on the bottom portion 723 of the siding 72 is locked to the upper locking part 23 of the fastening fixture 2 previously fixed to the furring 6.

Then, as shown in FIG. 5C, the other fastening fixture 2 fitted up on the top portion 724 of the siding 72 is fixed to the furring 6 with nails 8.

Figure 6:
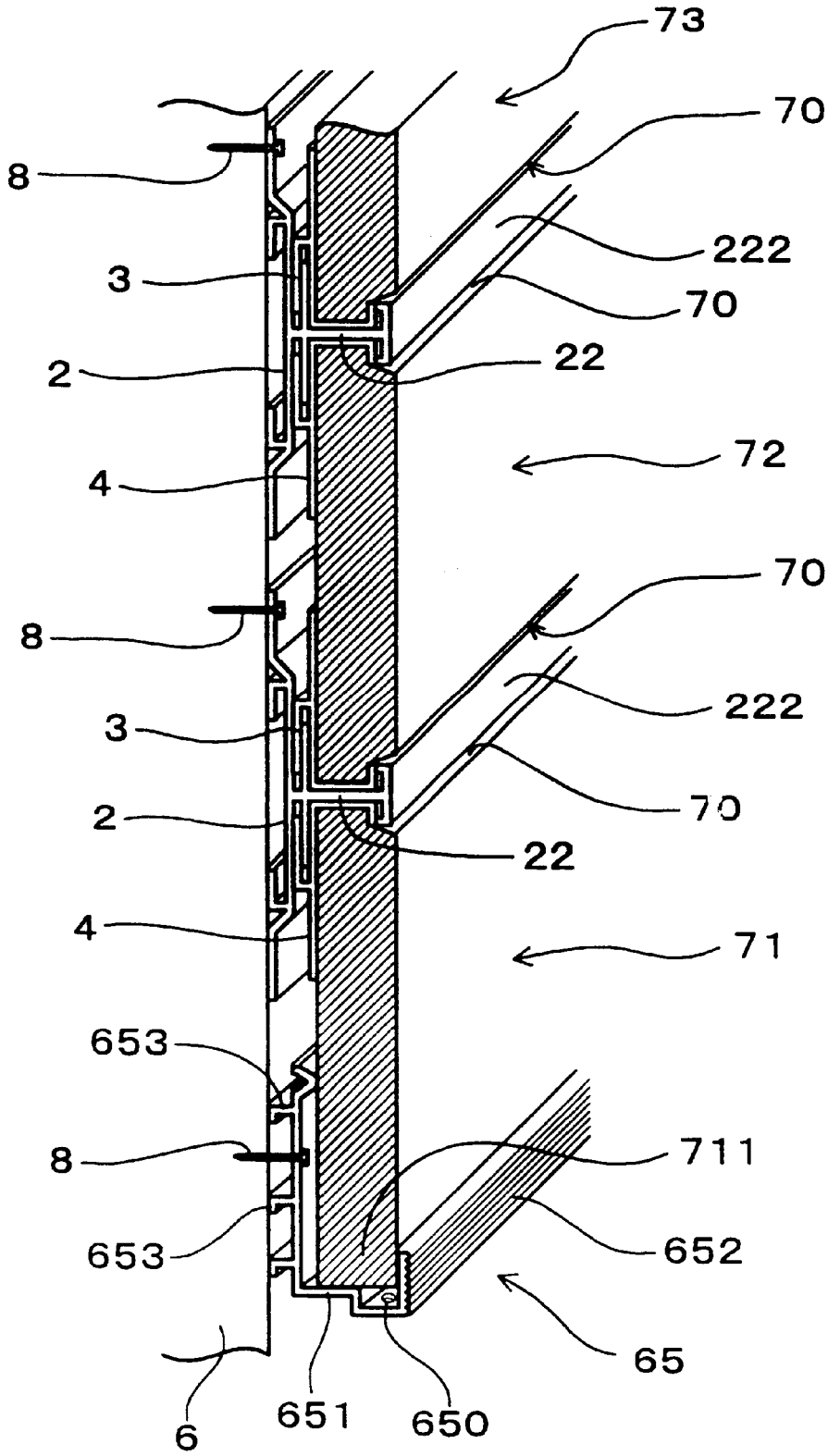
FIG. 6 is a perspective view partly in section showing a construction of installed vertical sidings in Embodiment 1.

Thereafter, as shown in FIG. 6, another siding 73 on which the upper fitting 3 and the fastening fixture 2 have been fitted up is fixed to the furring 6 such that the siding 73 is positioned above the siding 72 in the same method as described above.

As shown in FIGS. 4 and 6, the ground sill flashing 65 has a front end 652 and a supporting part 651 to support the bottom portion 711 of the siding 71 to be provided at the lowest stage. The ground sill flashing 65 has a rear leg portion 653 having an L-shape in section to be contacted the furring 6 and allow the siding 71 to be vertically installed. A drainage hole 650 (see FIG. 4) is formed on a bottom surface of the supporting part 651.

The construction of the vertical siding completed by the installing method will be described below.

As shown in FIGS. 1 and 6, in the construction, the fixing part 21 of the fastening fixture 2 is fixed to the furring 6, and the upper and lower fittings 3 and 4 are locked to the upper and lower locking parts 23 and 24, respectively positioned between the fixing part 21 and the supporting part 22 of the fastening fixture 2.

Further, in this construction, the bottom portion 723 of the upper siding 72 is fittingly fixed in the upper fitting 3, and the top portion 712 of the lower siding 71 is fittingly fixed in the lower fitting 4.

The sidings 71 to 73 are formed of ceramics external wall materials.

As shown in FIGS. 1 and 6, a concave stepped portion 70 is provided with front-side corners of each of the sidings 71 to 73 by embossing. A belt-shaped plate 222 provided with a head of the supporting part 22 of the fastening fixture 2 is arranged inside the concave stepped portion 70.

Figure 7:
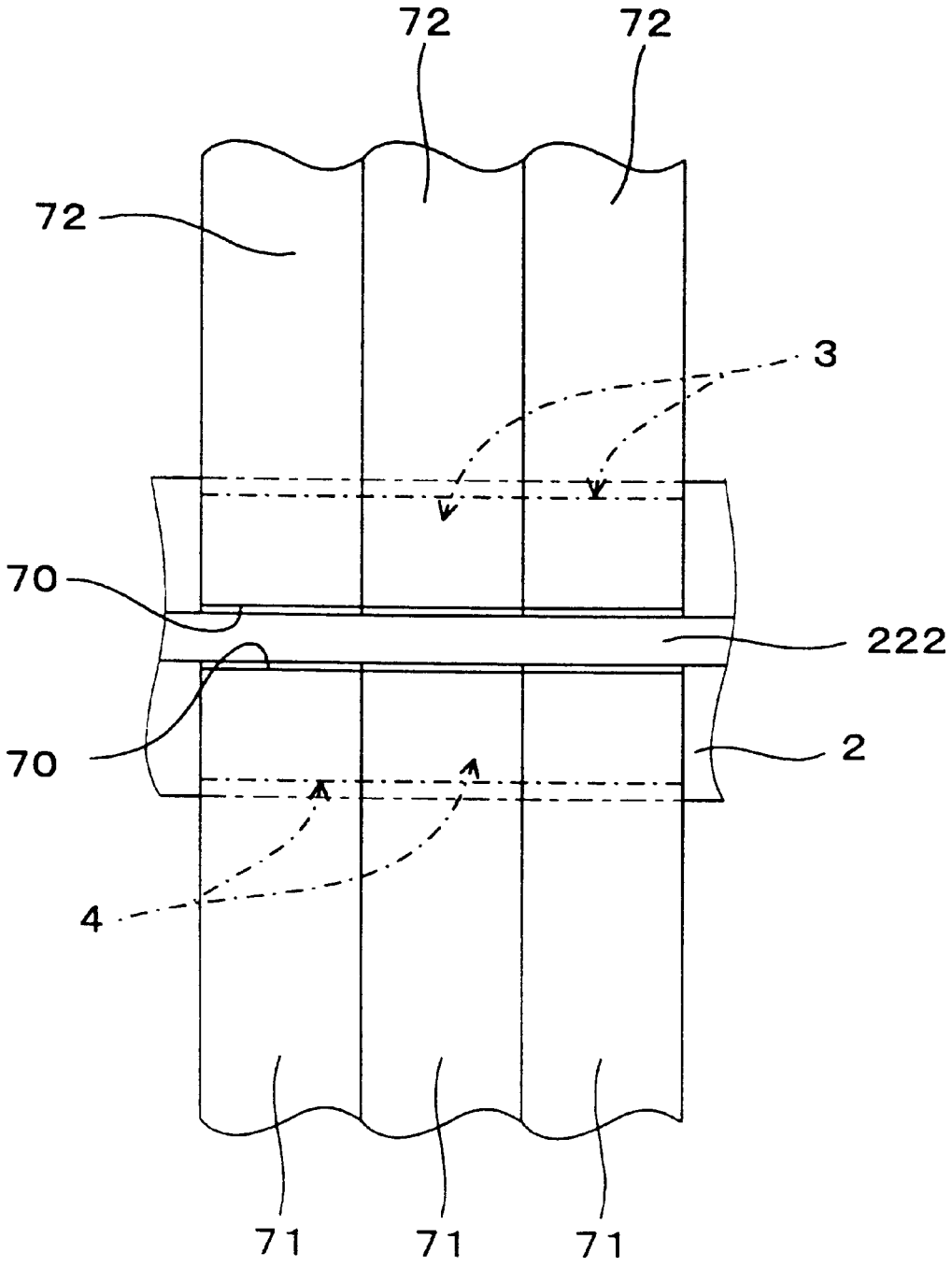
FIG. 7 is a front view showing the construction of the installed vertical sidings in Embodiment 1.
Figure 8:
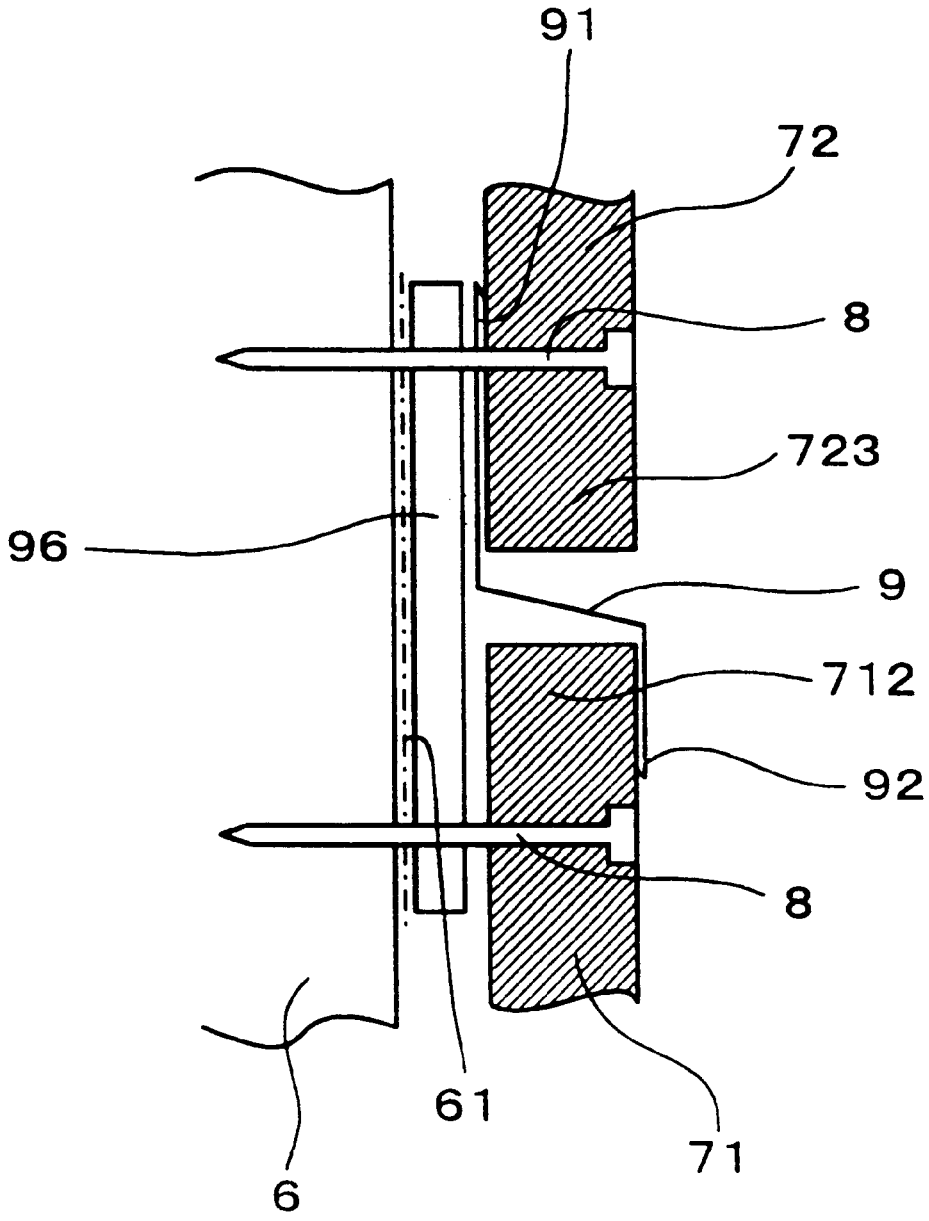
FIG. 8 PRIOR ART
FIG. 8 is a vertical sectional view showing a flashing at completion of installation in a conventional art.
Figure 9:
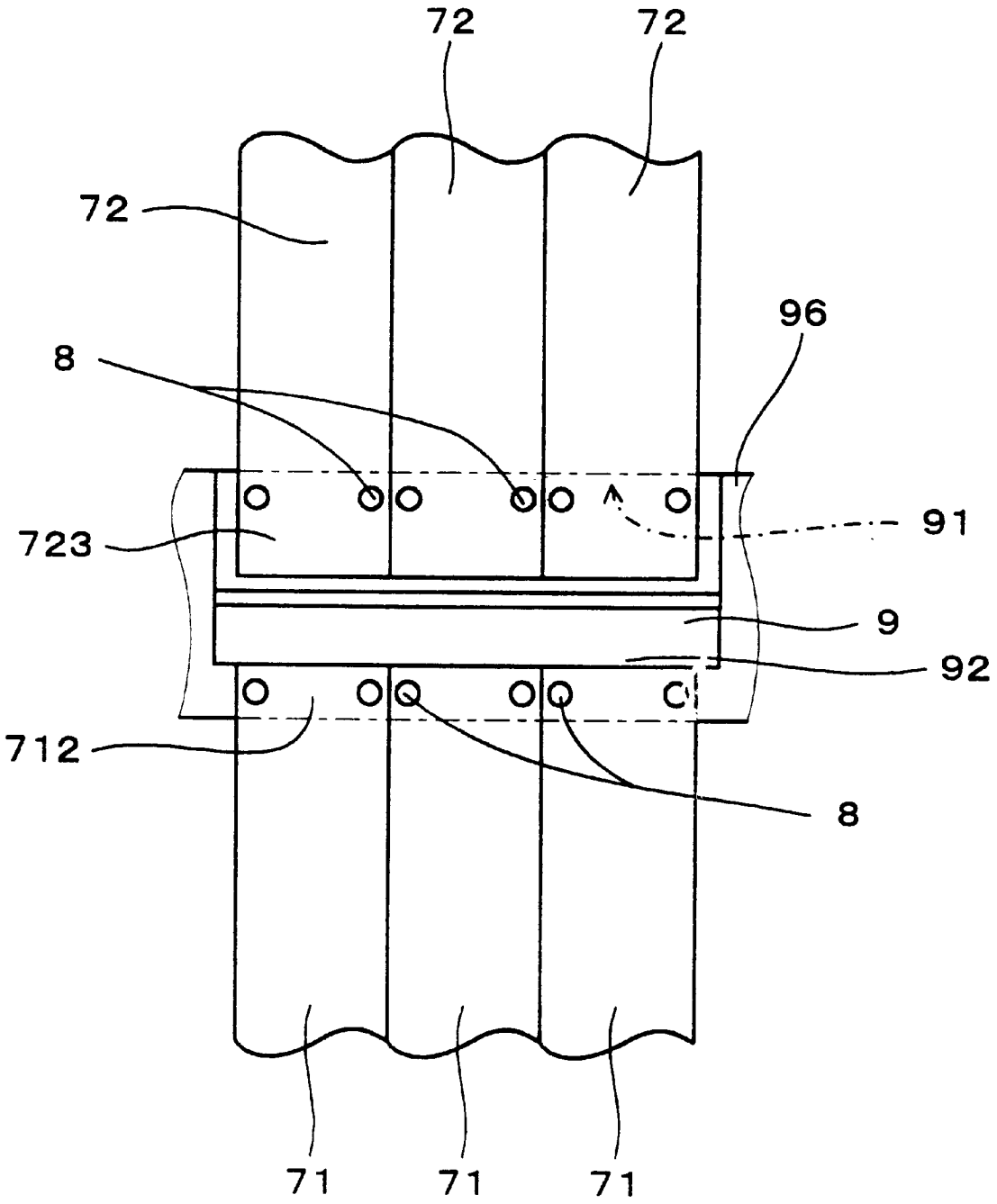
FIG. 9 PRIOR ART
FIG. 9 is a front view showing a construction of installed vertical sidings in a conventional art.

As shown in FIG. 7, the widths of the upper fitting 3 and that of the lower fitting 4 are almost equal to that of each of the sidings 71 and 72, respectively, and are arranged such that the center of each thereof is aligned with those of each of the sidings 71 and 72.

The operation and effect of this embodiment will be described below.

As shown in FIG. 1, the sidings 71 and 72 are supported by the fastening fixture 2 fixed to the furring 6 through the upper and lower fitting 3 and 4. Thus, it is possible to securely fix the sidings 71 and 72 to the furring 6, with the sidings 71 and 72 vertically adjacent to each other.

The sidings 71 and 72 are fixed to the furring 6 through the three kinds of metal fixtures constituting the fixture assembly 1.

Accordingly, no nails are required to be driven into the sidings 71 and 72 and the head of the nail is not exposed on the surface of the sidings 71 and 72. This leads to an improved siding appearance.

The upper fitting 3 is fittingly fixed on the bottom portion 723 of the siding 72 with an adhesive agent. Accordingly, as shown in FIG. 1, a gap is not formed between the upper fitting 3 and the rear surface of the siding 72. Thus, rainwater does not penetrate inward from the gap between the upper fitting 3 and the siding 72.

Similarly, rainwater does not penetrate into the inside of the siding 71 from the gap between the lower fitting 4 and the siding 71.

As shown in FIG. 1, the upper fitting 3 can be locked to the upper locking part 23 of the fastening fixture 2, with a space 5 formed between the fastening fixture 2 and the upper fitting 3. Thus, with the sidings 71 and 72 fixed to the furring 6, it is possible to function the space 5 as an air pocket. Namely, even though a slight gap is formed between the fastening fixture 2 and the upper fitting 3 and even though rainwater penetrates thereinto, it is possible to prevent rainwater from penetrating inward from the space 5.

Similarly, the space 5 formed between the fastening fixture 2 and the lower fitting 4 prevents rainwater from penetrating inward.

The upper locking part 23 of the fastening fixture 2 is plate-shaped. The upper fitting 3 has the plate-shaped hooking portion 31 to be locked to the upper locking part 23. Thus, as shown in FIG. 5B, the upper fitting 3 can be easily locked to the fastening fixture 2. Similarly, the lower fitting 4 and the fastening fixture 2 can be easily locked to each other.

The fastening fixture 2, the upper fitting 3, and the lower fitting 4 are produced by molding an aluminum material. Thus, the above three kinds of fixtures can be more smoothly inserting-locked than those formed by molding an iron material.

As shown in FIG. 2, the fixing part 21 of the fastening metal fixture 2 has the fixing plate portion 212 bent-formed toward a side nearer to the furring than to the main plate portion 211. Thus, the fastening fixture 2 allows the sidings 71 and 72 to be installed on the furring 6, with a ventilation provided between the main plate portion 211 and the furring 6, enabling the installation of the sidings 71 and 72 to be easy.

The main plate portion 2 11 has the bottom plate 213 flush with the fixing plate portion 212. Thus, with the ventilation layer provided by the bottom plate 213 between the main plate portion 211 and the furring 6, the sidings 71 and 72 can be securely fixed to the furring 6.

The supporting part 22 of the fastening fixture 2 has the belt-shaped plate 222 formed at the front end portion thereof. Thus, it is possible to prevent the front end of the upper fitting 3 and that of the lower fitting 4 from being displaced from the predetermined position, respectively.

As shown in FIG. 6, the belt-shaped plate 222 allows the gap (horizontal joint) between the sidings 71 and 72 vertically adjacent to each other to have an excellent appearance, leading to improved design properties of the sidings 71 and 72.

The concave stepped portion 70 is formed at the front top portion 712 of the siding 71 and the front bottom portion 723 of the siding 72. The belt-shaped plate 222 is accommodated in each concave stepped portion 70. Therefore, it is possible to position the belt-shaped plate 222 rearward from the front surface of each of the sidings 71 and 72. Thus, as shown in FIG. 6, the finish of the horizontal joint can be made excellent and neat.

In the construction having the sidings completed by the installing method of Embodiment 1, because the fixture assembly 1 is used, a nail head is not exposed on the surface of the sidings 71 and 72, as shown in FIG. 7. Accordingly, it is unnecessary to apply patching-up paint to the nail head or mount a kneehole panel on the surface of each of the sidings 71 and 72 after being fixed to the furring 6. Therefore, it is possible to install the sidings 71 and 72 in a short period of time, achieving a remarkably reduced building cost.

In the installing method of Embodiment 1, as shown in FIG. 5A, the upper and lower fittings 3 and 4 are fitted on the upper and bottom portions 724 and 723 of the siding 72 respectively in advance and the fastening fixture 2 is locked to the lower fitting 4 such that the siding 72 and the above three kinds of fixtures are integrated.

Thus, as shown in FIG. 5B, fixing of the fastening fixture 2 on the furring 6 and fixing of the siding 72 thereon can be accomplished simultaneously. Therefore, this method allows the installation of the siding to be performed more easily than the method of sequentially installing the fastening fixture 2, the upper and lower fittings 3 and 4, and the sidings 71 to 73.

The fastening fixture 2 can be fixed to the furring 6 through horizontal furring strips or building paper.

Obviously, numerous modifications and variations of the present invention are possible in light of the above teachings. It is therefore to be understood that within the scope of the appended claims, the invention may be practiced otherwise than as specifically described herein.

What is claimed is:

1. A metal fixture assembly for installation of a vertical siding and adapted to be arranged between vertical sidings vertically adjacent to each other, comprising:

a fastening metal fixture adapted to be fixed to a furring;

an upper metal fitting adapted to be provided between the fastening metal fixture and an upper siding and adapted to be fittingly fixed on a bottom portion of the upper siding; and a lower metal fitting adapted to be provided between the fastening metal fixture and a lower siding and adapted to be fittingly fixed on a top portion of the lower siding;

wherein the fastening metal fixture integrally includes a fixing part adapted to be fixed to the furring, a supporting part projecting from the fixing part and adapted to support the sidings, an upper locking part provided between the fixing part and the supporting part which locks the upper metal fitting, and a lower locking part provided between the fixing part and the supporting part which locks the lower metal fitting.

2. The metal fixture assembly according to claim 1, wherein the upper locking part and the lower locking part of the fastening metal fixture are plate-shaped, and the upper metal fitting has a plate-shaped hooking portion locked to the upper locking part, and the lower metal fitting has a plate-shaped hooking portion locked to the lower locking part.

3. The metal fixture assembly according to claim 1, wherein the fixing part of the fastening metal fixture has a main plate portion from which the supporting part projects toward the face of siding and a pair of fixing plate portions formed at each of upper and bottom portions of the main plate portion, and the fixing plate portion is bent-formed toward a side nearer to the furring than the main plate portion.

4. The metal fixture assembly according to claim 3, wherein the main plate portion has a bottom plate flush with the pair of fixing plate portions.

5. The metal fixture assembly according to claim 1, wherein the supporting part has a belt-shaped plate at a front end thereof.

6. A construction having vertical sidings installed on a furring with the metal fixture assembly of claim 1, wherein the fixing part of the fastening metal fixture is fixed to a furring; and upper and lower metal fittings are locked to upper and lower locking parts, respectively provided between the fixing part of the fastening metal fixture and the supporting part thereof; and a bottom portion of the upper siding is fittingly fixed in the upper metal fitting, and a top portion of the lower siding is fittingly fixed in the lower metal fitting.

7. A method of installing vertical sidings on a furring by using the metal fixture assembly of claim 1, comprising the steps of:

fittingly fixing the upper metal fitting on a bottom portion of a first siding and fittingly fixing the lower metal fitting on a top portion of the first siding;

locking the lower locking part of the fastening metal fixture to the lower metal fitting to fit up the fastening metal fixture on the top portion of the first siding;

locking an upper metal fitting fittingly fixed on the bottom portion of the first siding to an upper locking part of another fastening metal fixture previously fixed to a furring;

fixing the fastening metal fixture fitted up on the top portion of the first siding to the furring; and fittingly fixing the upper metal fitting on a bottom portion of a second siding, and fitting the fastening metal fixture on a top portion of said second siding through the lower metal fitting to install upward said second siding on the first siding which has previously been fixed on the furring.

8. The method according to claim 7, wherein the lower metal fitting is fittingly fixed on a top portion of a first siding positioned at a lowest stage; the lower locking part of the fastening metal fixture is locked to the lower metal fitting to fit up the fastening metal fixture on the top portion of the first siding; a bottom portion of the first siding is fittingly fixed in a ground sill flashing previously provided on the furring at a lower portion thereof; and the fastening metal fixture previously fitted on the top portion of the first siding is fixed to the furring.

* * * * *